US007534947B2

(12) United States Patent
Heng et al.

(10) Patent No.: US 7,534,947 B2
(45) Date of Patent: May 19, 2009

(54) OBOE REED GOUGE APPARATUS

(75) Inventors: Udo Heng, Annaberg-Bucholz (DE); Andrea J. Ridilla, Oxford, OH (US)

(73) Assignee: Miami University, Oxford, OH (US)

( * ) Notice: Subject to any disclaimer, the term of this patent is extended or adjusted under 35 U.S.C. 154(b) by 0 days.

(21) Appl. No.: 11/781,639

(22) Filed: Jul. 23, 2007

(65) Prior Publication Data

US 2008/0017013 A1 Jan. 24, 2008

Related U.S. Application Data

(60) Provisional application No. 60/832,388, filed on Jul. 21, 2006.

(51) Int. Cl.
*G10D 9/02* (2006.01)
*G10D 7/06* (2006.01)
*G10G 7/00* (2006.01)

(52) U.S. Cl. ..... 84/383 A; 84/380 R; 84/380 A; 84/458

(58) Field of Classification Search ..... 84/383 A
See application file for complete search history.

(56) References Cited

U.S. PATENT DOCUMENTS 4,273,170 A * 6/1981 Herzberg et al. ..... 144/115
4,572,257 A * 2/1986 Laker ..... 144/115
4,669,515 A * 6/1987 Trent ..... 144/115
4,708,182 A * 11/1987 Laker ..... 144/369
6,683,238 B1 * 1/2004 Driscoll, Jr. ..... 84/383 A

FOREIGN PATENT DOCUMENTS

DE 19947278 11/2000

* cited by examiner

*Primary Examiner*—Jeffrey Donels
*Assistant Examiner*—Christopher Uhlir
(74) *Attorney, Agent, or Firm*—Jason H. Foster; Kremblas, Foster, Phillips & Pollick

(57) ABSTRACT

An oboe reed gouge device has a carriage upon which a blade is carried at an angle to raw cane material from which a reed is formed. The carriage is rotatably and longitudinally slidable on a rod to move relative to the cane. The rod has opposing end segments with coincident axes that are offset from the axis of a central rod segment. By rotating the rod about the axes of the end segments, the carriage, which is mounted on the central rod segment, is moved laterally relative to the cane. By mounting a gauge finger against the central rod segment, the amount of lateral displacement can be measured and displayed. A groove is formed in the carriage, and the blade is mounted in the groove using a pin with a drive screw, and a second screw to lock the blade in position.

10 Claims, 4 Drawing Sheets

OBOE REED GOUGE APPARATUS

CROSS-REFERENCE TO RELATED APPLICATIONS

This application claims the benefit of U.S. Provisional Application No. 60/832,388 filed Jul. 21, 2006.

STATEMENT REGARDING FEDERALLY-SPONSORED RESEARCH AND DEVELOPMENT

Not Applicable

REFERENCE TO AN APPENDIX

Not Applicable

BACKGROUND OF THE INVENTION

1. Field of the Invention

This invention relates generally to devices used for forming reeds for musical instruments.

2. Description of the Related Art

Playing the oboe requires the use of a double reed that is fabricated by hand according to specific physical characteristics. Oboe reeds have a very short life span, which can be on the order of 12-14 hours of playing time. Thus, a professional oboist must keep several on hand for use. The reed fabricating process is laborious, because oboe reeds are made from natural cane (*Arundo donax*), that begins as a tubular structure, and is carved or "gouged" into a thin, flat strip that eventually vibrates as air is blown between the two reeds. Most accomplished musicians make their own reeds in order to meet their own unique demands. For example, each oboist desires reeds having a particular "middle-to-side ratio" to fit her own particular mouth size and shape, playing styles and other factors. The typical manner of obtaining the desired characteristics is to experiment by fabricating reeds that have characteristics that vary across the width of the reed—a thicker center and thinner sides. However, this is conventionally very imprecise and not readily repeated.

Originally, reedmaking was carried out by hand-gouging the cane. More recently, hand-operated machines have become available to gouge oboe cane, such as those sold by Innoledy, LLC of Weymouth, Mass. (www.innoledy.com), and the machine disclosed in German patent 19947278. These machines eliminate some, but not all, of the difficulty in fabricating reeds, but create other problems involving machine setup and the ability to repeat the actions that result in excellent reeds. The gouging blade of such machines is curved to form reeds having a thick center and thin sides, but the resulting reed may not have the exact curvature and middle-to-side ratio desired. Although machines can be extremely helpful due to the fact that they permit repetition of particular actions, machines can be relatively inflexible in the actions that are possible.

One conventional oboe gouge apparatus has a blade that is mounted to a moveable carriage. The blade is positioned, in the manner of a wood-plane, at a significant angle relative to the cane, and its depth and position can be adjusted using many screws that seat against different sides of the blade. The carriage slides relative to a sturdy base to which the cane is securely mounted, and the blade removes material from the cane in each of multiple passes to form the finished piece of cane. Turning each screw adjusts the blade relative to the carriage, but there are significant gaps between the carriage and the blade to permit the user to mount the blade in various positions. This adjustability makes it very difficult to position the blade where it is desired. For example, it is considered disadvantageous to remove more than 0.06 millimeters of cane during each gouging pass due to the deleterious effects that greater gouging has on the remaining cane material (e.g., deformation due to compression). In order to adjust the blade to remove 0.06 mm of cane, one must not only adjust the blade depth, but also the blade's angle and lateral alignment (side-to-side position). This is extremely difficult in conventional machines, and such machines require a "trial and error" method to position the blade.

Additionally, with conventional machines one slides the carriage along the cane's length, starting at one end. The sliding moves in one direction, and when the end is reached the carriage is lifted by pivoting it around the rod and sliding it to the first end. Then gouging is repeated until the desired cane thickness and shape is obtained. This is determined, in large part however, by the shape of the blade, because the blade gouges thin sheets of material from the cane that correspond to the shape of the sharp tip of the blade. However, a particular blade may leave behind a reed having a different radius of curvature, which would affect the middle-to-side ratio that is so important to oboists.

Therefore, the need exists for a cane gouging apparatus for making oboe reeds.

BRIEF SUMMARY OF THE INVENTION

Figure 1:
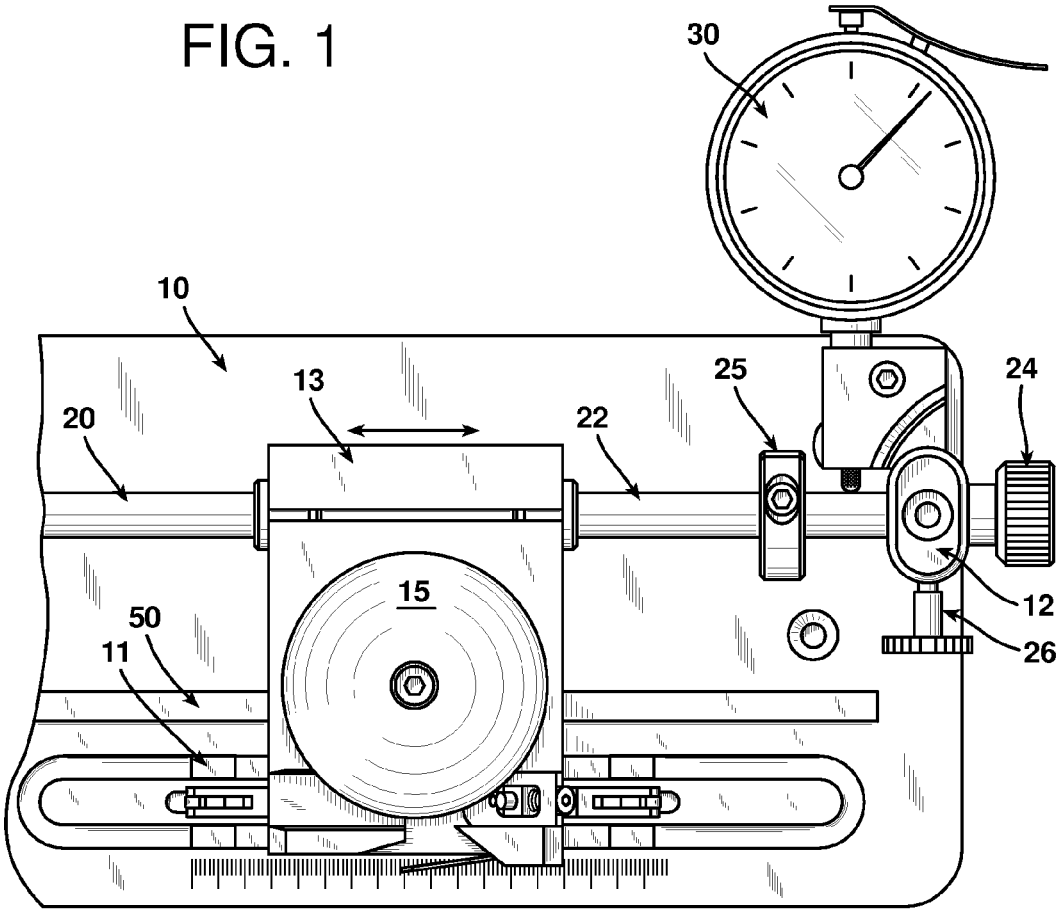
FIG. 1 is a top view illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

The invention is shown in FIG. 1 having a flat, rigid base, such as the metal plate 10, to which cane is mounted in a bed 11 in a conventional manner. A blade (not visible in FIG. 1) is immovably mounted in a carriage 13, which is slidably mounted on a smooth rod 20. The blade is mounted at an angle to the axis of the cane to permit gouging as the carriage is moved back and forth along the rod 20, which is substantially parallel to the axis of the cane. The carriage 13 is longitudinally and rotatably mounted to the rod 20, and therefore the carriage 13 can hinge up and over the rod 20, for example, to make room above the bed 11 to insert cane in the bed 11.

Conventional bearings in the carriage 13 seat against the rod 20 to ensure smooth and precise motion of the carriage 13 along and around the rod 20 with no significant radial movement of the carriage 13 relative to the rod 20.

To commence gouging, the carriage 13 is moved by hand-gripping the knob 15 to bring the blade into contact with the cane at one end (the right end in the embodiment of FIG. 1) of the bed 11. The carriage is displaced toward the other end of the cane along the cane's entire length. During gouging, a thin shaving of about 0.06 mm in thickness or less is cut from the cane as determined by pressure applied to the carriage 13 and other factors known to the person skilled in the art. The adjustable stop 25 provides a limit to the rightward movement of the carriage 13 beyond the rightward end of the bed 11.

Figure 2:
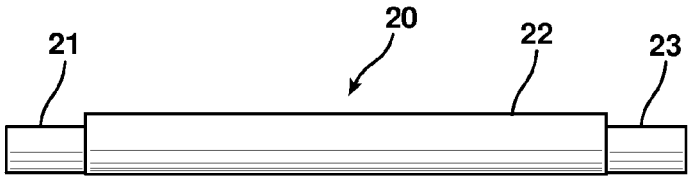
FIG. 2 is a side view illustrating a rod on which the carriage is mounted.
Figure 3:
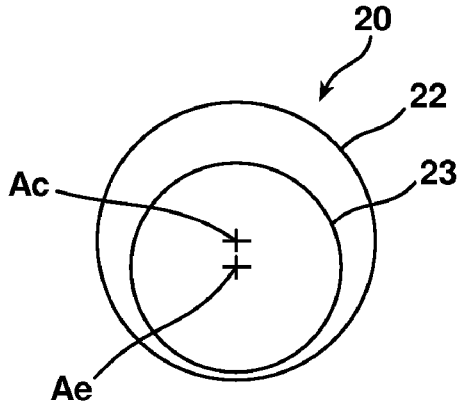
FIG. 3 is an end view illustrating the rod of FIG. 2.

The bosses 12 and 14 (substantially identical boss 14 is not visible in FIG. 1) are immovably mounted at opposite ends of the plate 10. The opposite ends of the rod 20 are rotatably mounted in bearings in the bosses 12 and 14 that prevent any substantial longitudinal or radial movement of the rod 20 relative to the bosses 12 and 14, but permit rotational (circumferential) movement of the rod 20. As shown in FIGS. 2 and 3, the rod 20 has a central segment 22 with a circular cylindrical cross-section, and opposing end segments 21 and 23 with circular cylindrical cross sections. The end segments 21 and 23 have axes of rotation Ae that are aligned with each other along a line, and that line is parallel to and radially offset from the axis Ac of the central rod segment as illustrated schematically in FIG. 3. The effect of this relationship is to form an eccentric as explained below.

Referring again to FIG. 1, the hand-grippable, knurled knob 24 is mounted to the end of the rod 20 coaxial with the axes of rotation Ae. By rotating the knob 24, such as by hand, the central rod segment 22 is rotated within the bosses 12 and 14. In order to restrict rotation of the rod 20 by the knob 24, the locking knob 26 can be rotated in a clockwise direction, thereby screwing the attached threaded shaft through the boss 12 and against the end segment 23 mounted therein. This binds the end segment 23 relative to the boss 12, thereby preventing rotation of the rod 20.

Because the central rod segment 22 is offset from the end segments 21 and 23 as described above, the central rod segment 22 moves as an eccentric when rotated about the offset axes of the end segments 21 and 23. Therefore, rotation of the rod 20 moves the central rod segment's 22 axis Ac around the axes Ae, and displaces the outer surface of the central rod segment 22 in the manner of an eccentric or cam. This displacement of the outer surface of the central rod segment 22 displaces the carriage 13, which follows the outer surface of the central rod segment 22. The rotation of the knob 14 results in the path of travel of the carriage 13 being displaced laterally relative to the base 10. By displacing the carriage 13 laterally, a user can position the carriage's blade over the bed 11 (and the mounted cane) at a position that permits gouging along a desired path center. This allows the user to affect the middle-to-side ratio of the finished reed. Thus, rotation of the knob 24 radially displaces the central rod segment 22 and, thereby, laterally displaces the blade, relative to the bed 11.

Figure 4:
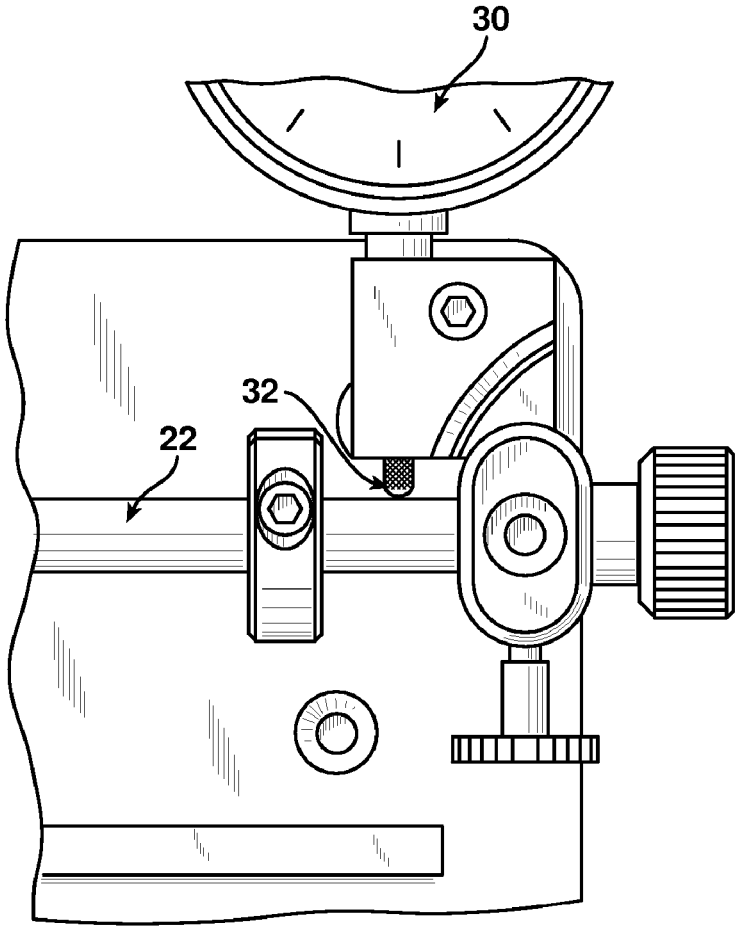
FIG. 4 is an enlarged top view illustrating the gauge and finger thereof in a preferred embodiment.

A measurement gauge 30 is mounted to the plate 10 with a gauge finger 32 (see FIG. 4) seated against the rod 20 at the central rod segment 22. As described above, the outer surface of the central rod segment 22 is a circular cylinder with an axis of rotation offset from the axes Ae of the end segments 21 and 23. The finger 32 is biased, such as with a spring, to seat against the surface of the central rod segment 22 on the opposite side of the rod 20 as the bed 11. Thus, the gauge 30 measures the radial displacement of that surface relative to a reference point, such as a zero position where the axis of the central segment 22 is between the axes of the end segments 21 and 23 (as shown in FIG. 3) and the finger 32. This displacement distance is then displayed on the gauge 30 face, for example, using a moving needle and a dial. Of course, digital and any other displays are contemplated.

Using the gauge 30, one can determine the exact amount the blade and carriage 13 are displaced laterally. The blade can be used to gouge further at this displaced position. In this position, the blade is displaced a known distance from the center of the cane. This known distance can be used by an operator of the apparatus in obtaining the desired middle-to-side ratio by, for example, removing more material from the side of the cane when the blade is laterally displaced. By noting the lateral displacement of the carriage during a successful gouge, one can later move the carriage the same distance, as measured by the gauge 30, to repeat the successful gouging technique. Thus, once the user is finished gouging a piece of cane to its appropriate thickness at the point where the blade contacts the cane's center line, the carriage and blade are moved laterally relative to the plate 10 and the cane to continue gouging at a desired lateral position, which is different from where the first series of passes occurred.

By permitting the user the freedom to position the center of the blade at the exact lateral position desired (by repeating the same displacement of the central rod segment 22 to the precise position as indicated by the gauge 30), the invention reduces the extent to which a blade's radius of curvature determines the middle-to-side ratio of the finished reed. Once the gouging is finished at that blade position, the user can then move the cane end-to-end to gouge the other side of the cane. Because of the location of the cane in the bed, this second set of passes extends along a path the same distance from the cane's center as when making the first set of passes at the laterally offset position. Thus, the finished reed should have a symmetrical middle-to-side ratio. Of course, one could make one side thinner than the other, if symmetry is not desired.

There is a roller bearing (not shown) mounted on the underside of the carriage 13 that rests on the bar 50 under the carriage. The bearing contacts the bar 50 only once the gouging is finished. The bar 50 thus acts as a vertical stop so that no more gouging occurs when contact is made between the bearing and the bar 50. As described above, it is generally desirable to remove no more than 0.06 mm shavings with each pass of the blade.

Figure 5:
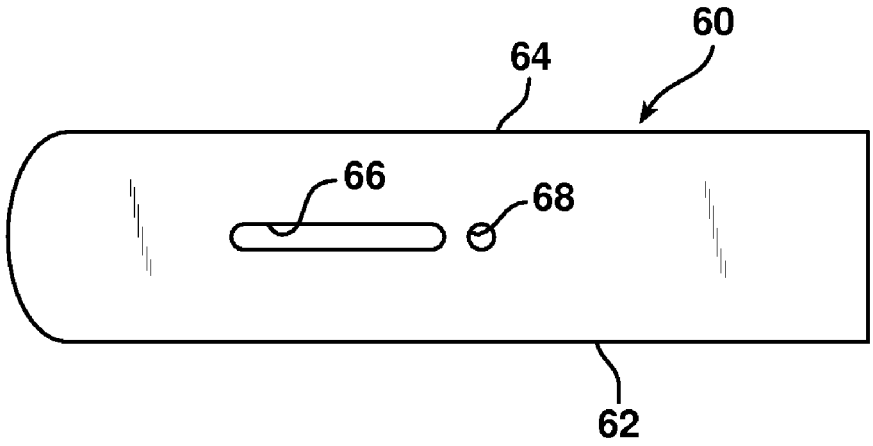
FIG. 5 is a top view illustrating the preferred blade.
Figure 6:
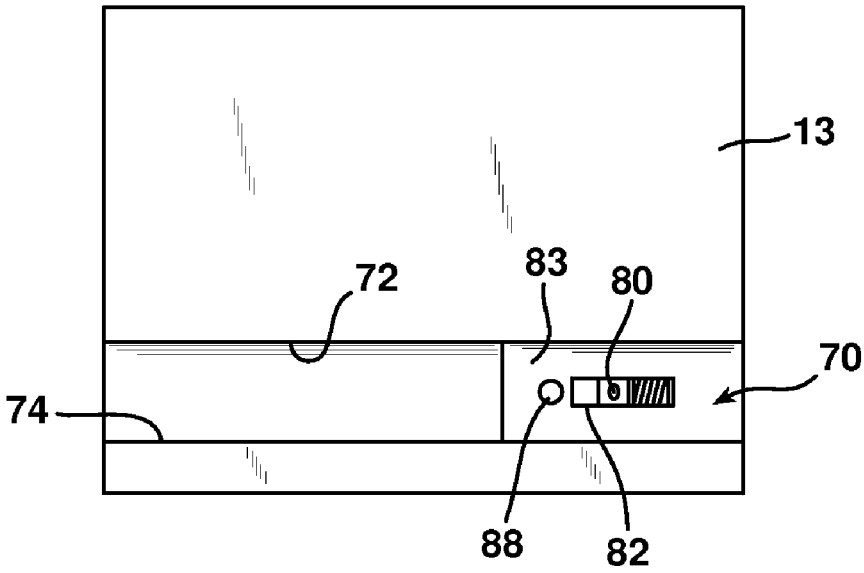
FIG. 6 is a top view illustrating the preferred carriage.
Figure 7:
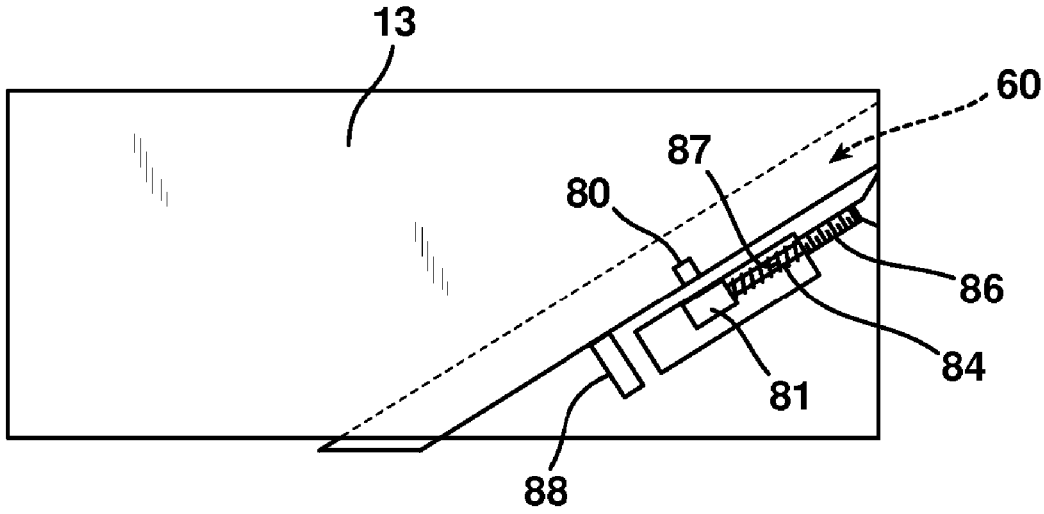
FIG. 7 is a side view illustrating the preferred carriage.

The blade 60 is mounted in the carriage 13 as illustrated in FIGS. 5-7. The blade 60 is shown in FIG. 5 having an elongated shape with opposing sidewalls 62 and 64 that are substantially parallel. A circular aperture 68 is formed in the underside of the blade 60, and the slot 66 is formed entirely through the blade.

The blade 60 is inserted into the groove 70 of the carriage 13 as shown in FIG. 6. The groove is defined by the opposing sidewalls 72 and 74, which are substantially parallel and spaced only slightly larger (on the order of one hundredth of a millimeter) than the distance between the sidewalls 62 and 64 of the blade 60. Thus, the blade 60 is tightly received in the substantially equal width groove 70, leaving only as much space for lateral movement of the blade 60 as is necessary to permit insertion of the blade 60 in the groove 70.

A pin 80 is mounted in a slot 82 in the floor 83 of the groove 70. The pin 80 is rigidly attached to a body 81 that is slidably mounted in the slot 82 (see FIG. 6). A screw 84 is rotatably mounted in the smooth-walled barrel 86 of the carriage 13 to permit rotation of the screw 84 without displacing the screw 84 longitudinally. Rotation of the screw 84, however, displaces the body 81 longitudinally along the slot 82, thereby displacing the pin 80 in the groove 70. A coil spring 87 is preferably extended around the screw 84 and seats against the body 81 at one end and the carriage near the left end (in the orientation shown in FIG. 7) of the barrel 86 at the opposite end. The spring 87 thus biases the pin 80 away from the head of the screw 84.

During installation, the pin 80 is inserted in the aperture 68 on the blade 60 and the spring 87 biases the blade 60 toward the bed 11. Once the blade 60 is on the pin 80, the blade 60 is limited to longitudinal movement with the pin 80, which moves when the screw 84 is rotated. The sidewalls 72 and 74 prevent lateral movement of the blade 60. The screw 84 is rotated to position the blade 60 longitudinally in the groove 70. Another screw (not shown) is inserted through the slot 66 of the blade 60 and into the threaded aperture 88 in the carriage 13. Once the blade 60 is positioned longitudinally with the sharp, lower end protruding beneath the lower plane of the carriage 13, the screw in the aperture 88 is tightened, which locks the blade 60 in place and prevents longitudinal movement of the blade relative to the carriage 13, even with rotation of the screw 84.

If the blade 60 is removed from the carriage 13, whether for replacement, sharpening, or any other reason, it can be re-installed simply by placing it in the groove 70 with the pin 80 inserted in the aperture 68. The screw 84 can be rotated to position the blade longitudinally, if necessary. Finally, a screw is inserted through the slot 66 and into the threaded hole 88 and tightened. The blade is then locked into position in the carriage. Of course, the blade 60 can be modified to include a smaller central slot and one or more additional openings and passages to accommodate another pin or other structure to hold the blade in place or adjust the blade.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus for gouging raw material to form a reed for a musical instrument, the apparatus comprising:

(a) a base on which at least two bearing bodies are rigidly mounted and a bed is mounted for holding the raw material;

(b) a rod having a circular cylindrical central segment and first and second circular end segments on opposite ends of the central segment, wherein the first and second end segments have a common axis that is parallel to, and radially spaced from, an axis of the central segment, and wherein the end segments are rotatably mounted in the bearing bodies with the central segment configured to rotate about the common axis of the end segments for displacing the central segment's axis relative to the bed; and (c) a carriage, having a gouging blade mounted thereto, the carriage being longitudinally slidably mounted on the central segment of the rod, wherein the central segment's axis defines a path of travel of the carriage.

2. The apparatus in accordance with claim 1, wherein the carriage further comprises:

(a) a groove formed in the carriage in which the blade is mounted, the groove having a width substantially equal to the blade width; and (b) means for mounting the blade to the carriage.

3. The apparatus in accordance with claim 2, further comprising means for adjusting the blade longitudinally in the groove.

4. The apparatus in accordance with claim 1, wherein the carriage further comprises:

(a) a groove formed in the carriage in which the blade is mounted against a groove floor, the groove having a width substantially equal to the blade width; and (b) a pin longitudinally adjustably mounted in a slot in the groove floor, the pin extending into an aperture in the blade.

5. The apparatus in accordance with claim 1, further comprising means for fixing the blade to the carriage.

6. The apparatus in accordance with claim 1, further comprising means for measuring displacement of the central segment's axis relative to the bed.

7. The apparatus in accordance with claim 1, further comprising a measuring gauge mounted against an outer surface of the central segment for measuring a displacement of the central segment's axis relative to the bed.

8. The apparatus in accordance with claim 7, further comprising a gauge display for displaying the measured displacement of the central segment's axis relative to the bed.

9. The apparatus in accordance with claim 8, further comprising at least one collars adjustably mounted on the rod for forming a longitudinal limit to the carriage's path of travel.

10. The apparatus in accordance with claim 8, further comprising a hand-grippable knob mounted on one end of the rod.

* * * * *